US010098479B1

(12) United States Patent
Muellerleile

(10) Patent No.: US 10,098,479 B1
(45) Date of Patent: Oct. 16, 2018

(54) SLATWALL WITH SLIDABLE CONNECTOR BRACKETS

(71) Applicant: MEGAWALL, INC., Comstock Park, MI (US)

(72) Inventor: Daniel Muellerleile, Grand Haven, MI (US)

(73) Assignee: MEGAWALL, INC., Comstock Park, MI (US)

( * ) Notice: Subject to any disclaimer, the term of this patent is extended or adjusted under 35 U.S.C. 154(b) by 0 days.

(21) Appl. No.: 15/136,009

(22) Filed: Apr. 22, 2016

(51) Int. Cl.
*A47F 5/00* (2006.01)
*A47F 5/08* (2006.01)
*A47F 5/10* (2006.01)

(52) U.S. Cl.
CPC ..... *A47F 5/0853* (2013.01); *A47F 5/0018* (2013.01); *A47F 5/0093* (2013.01); *A47F 5/103* (2013.01)

(58) Field of Classification Search
CPC ..... A47F 5/0853; A47F 5/0093; A47F 5/103; A47F 5/0018
USPC ..... 211/94.01
See application file for complete search history.

(56) References Cited

U.S. PATENT DOCUMENTS 3,496,889 A * 2/1970 Protzmann ..... A47B 19/00 108/152
3,886,698 A * 6/1975 Raith ..... A47B 57/404 211/126.16
4,155,459 A * 5/1979 Marschak ..... A47F 5/0823 211/49.1
4,349,113 A * 9/1982 Schreiner ..... A47B 96/067 211/103
4,352,478 A * 10/1982 Loew ..... A47F 5/0853 248/220.31
4,401,222 A * 8/1983 Kulikowski ..... A47B 96/067 211/103
4,607,753 A * 8/1986 Radek ..... A47F 5/0846 211/189
4,961,295 A * 10/1990 Kosch, Sr. ..... A47F 5/0846 211/94.02
5,409,120 A * 4/1995 Miller ..... A47F 5/0846 211/85.26
5,412,912 A * 5/1995 Alves ..... A47F 5/0846 211/94.01

(Continued)

FOREIGN PATENT DOCUMENTS

EP 2353459 A1 * 8/2011 ..... A47F 5/0815

*Primary Examiner* — Stanton L Krycinski
(74) *Attorney, Agent, or Firm* — Shlesinger, Arkwright & Garvey LLP

(57) ABSTRACT

A slatwall for displaying merchandise comprises first and second slatwall panels each having a front side and a rear side, a left edge portion and an opposite right edge portion, a top edge portion and a bottom edge portion. The bottom edge portion of the first slatwall panel is joined to the top edge portion of said second slatwall panel. The front side includes a plurality of parallel. The rear side includes first and second first C-shaped slots extending from the left edge portion to the opposite right edge portion, the first C-shaped slot is disposed parallel to and above the second C-shaped slot. First and second L-shaped brackets each includes first and second base portions transverse to a hanger portion. The base portions are slidable along and retained in the respective second C-shaped slot of the first slatwall panel and the first C-shaped slot of the second slatwall panel.

14 Claims, 5 Drawing Sheets

(56) References Cited

U.S. PATENT DOCUMENTS

| | | | | | |
|---|---|---|---|---|---|
| 5,819,490 | A * | 10/1998 | Current | A47F 5/0846 | 211/94.01 |
| 5,899,344 | A * | 5/1999 | Current | A47F 5/0846 | 211/94.01 |
| 5,944,203 | A * | 8/1999 | Vlah | A47F 5/0846 | 211/189 |
| 5,983,574 | A * | 11/1999 | Holztrager | A47F 5/0846 | 211/87.01 |
| 6,164,467 | A * | 12/2000 | DePottey | A47F 5/0846 | 211/189 |
| 6,945,414 | B1 * | 9/2005 | Stevens | A47F 5/0846 | 211/183 |
| D511,581 | S * | 11/2005 | Holztrager | D25/123 | |
| 7,198,159 | B2 * | 4/2007 | Fischer | A47F 5/0846 | 211/189 |
| 7,228,977 | B2 * | 6/2007 | Perkins | A47B 83/001 | 211/87.01 |
| D613,520 | S * | 4/2010 | Goodman | D25/138 | |
| 7,954,648 | B2 * | 6/2011 | Takashima | A47F 1/12 | 211/59.3 |
| D738,146 | S * | 9/2015 | Honermann | D6/683.1 | |
| 2005/0193641 | A1 * | 9/2005 | Fischer | A47B 96/067 | 52/36.5 |
| 2006/0091094 | A1 * | 5/2006 | Schuberth | A47F 5/0846 | 211/94.01 |
| 2007/0056921 | A1 * | 3/2007 | Lo | A47B 95/008 | 211/94.01 |
| 2007/0221594 | A1 * | 9/2007 | Pierro | A47F 5/0846 | 211/94.01 |
| 2009/0134290 | A1 * | 5/2009 | Begic | F16M 13/02 | 248/222.13 |
| 2011/0303798 | A1 * | 12/2011 | Bader | A47B 96/067 | 248/65 |

* cited by examiner

SLATWALL WITH SLIDABLE CONNECTOR BRACKETS

FIELD OF THE INVENTION

The present invention is generally directed to a slatwall for displaying merchandise and particularly to a free-standing or wall-attached slatwall with slidable connector brackets.

SUMMARY OF THE INVENTION

The present invention provides a slatwall for displaying merchandise, comprising first and second slatwall panels having a front side and a rear side, the slatwall panels including a left edge portion and an opposite right edge portion, each of the slatwall panels including a top edge portion and a bottom edge portion, the bottom edge portion of the first slatwall panel is joined to the top edge portion of the second slatwall panel. The front side includes a plurality of parallel grooves for securing thereto a plurality of standard display brackets. The rear side includes first and second first C-shaped slots extending from the left edge portion to the opposite right edge portion. The first C-shaped slot is disposed parallel to and above the second C-shaped slot. First and second L-shaped brackets each includes first and second base portions transverse to a hanger portion. The base portions are slidable along and retained in the respective second C-shaped slot of the first slatwall panel and the first C-shaped slot of the second slatwall panel. The hanger portion is attachable to a post. The first L-shaped bracket is a mirror image of the second L-shaped bracket.

The present invention also provides a slatwall system for displaying merchandise, comprising a slatwall panel including a front side and a rear side, the slatwall panel including a left edge portion and an opposite right edge portion, a top edge portion and a bottom edge portion. The front side includes a plurality of parallel grooves for securing thereto a plurality of support brackets. The rear side includes a C-shaped slot extending from the left edge portion to the opposite right edge portion. First and second L-shaped brackets attach the slatwall panel to respective posts. The first and second L-shaped brackets each includes a base portion transverse to a hanger portion. The hanger portion is attachable to a respective post. The first L-shaped bracket is a mirror image of the second L-shaped bracket. The base portion is slidable along and retained in the C-shaped slot.

DETAILED DESCRIPTION OF THE INVENTION

Figure 1:
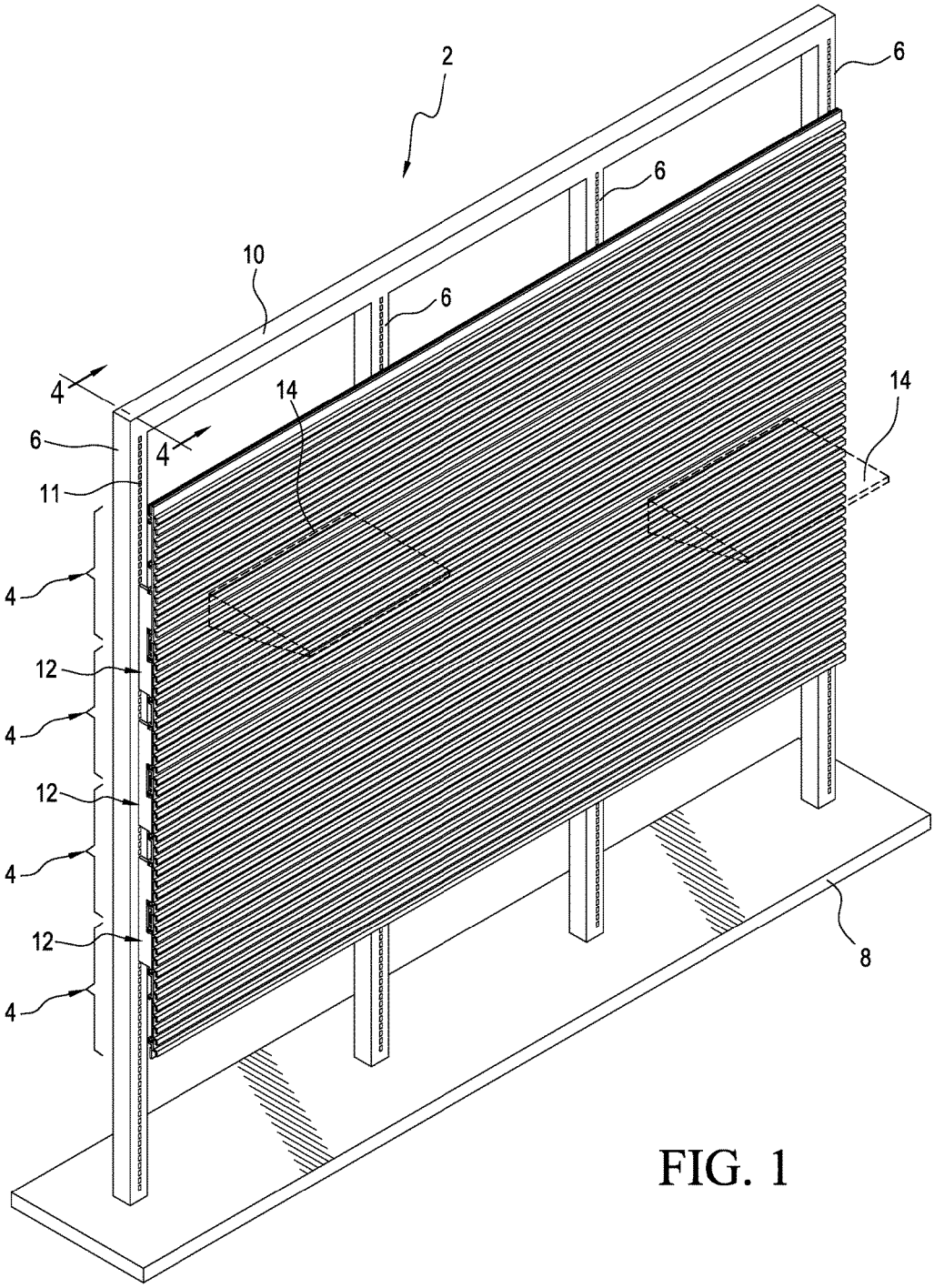
FIG. 1 is a perspective view of a slatwall embodying the present invention.

A slatwall 2 embodying the present invention is disclosed in FIG. 1. The slatwall 2 includes a plurality of slatwall panels 4 supported by a plurality of posts 6 attached to a base 8. A horizontal member 10 attached to the posts 6 may be used to stabilize the upper portions of the posts 6. The posts 6 are made of tubular metal with a series of equally spaced rectangular openings 11 for receiving a plurality of brackets 12.

The brackets 12 are attached to the posts 6 and to the backside of the slatwall panels 4. Each of the posts 6 may have the brackets 12 attached to them, or some posts may have none of the brackets. The posts 6 are not limited to a specific spacing from each other since the brackets 12 can move to the location of the posts, as will be explained below.

While the slatwall 2 is shown as free-standing, supported by the posts 6 and the base 8, the slatwall 2 may also be attached to an existing wall by attaching the posts 6 to the wall, in which case the base 8 is not used. The slatwall 2 is used to support display brackets (not shown) or standard shelves 14 on which merchandise is placed so as to be visible to the consumer.

Figure 2:
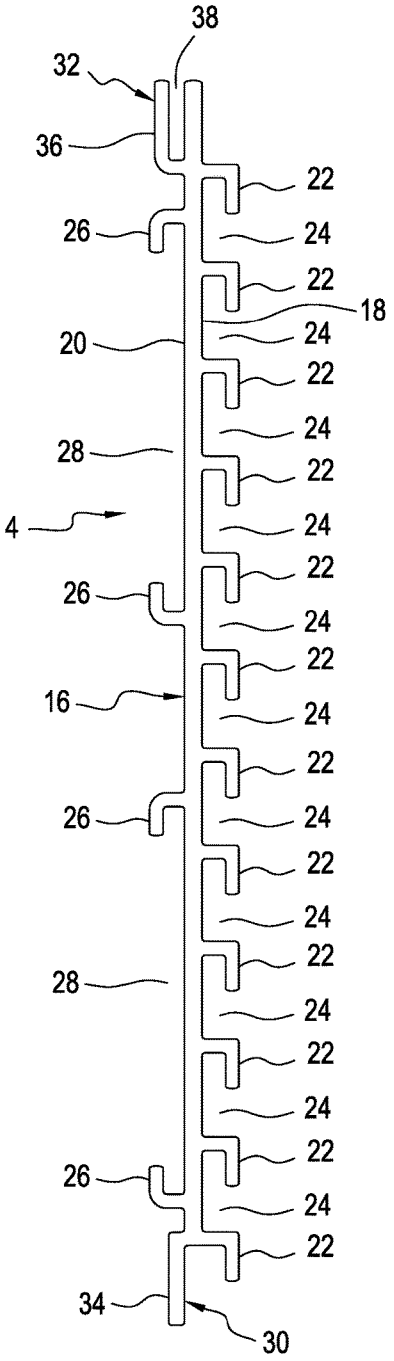
FIG. 2 is an edge view of a slatwall panel embodying the present invention.

Referring to FIG. 2, one of the slatwall panels 4 is shown in edge view. The slatwall panel 4 includes a base wall portion 16 with a front surface 18 and a rear surface 20. The base wall portion 16 is preferably flat or planar. A plurality of L-shaped portions 22 extend from the front surface 18 and are parallel and spaced apart from each other to form a plurality of parallel grooves 24. The L-shaped portions 22 extend through the entire width of the slatwall 4. The grooves 24 are configured to receive the tab portions of standard slatwall display brackets (not shown) that lock with the L-shaped portions 22 to secure the brackets in place.

L-shaped portions 26 extend rearwardly from the rear surface 20 of the base wall portion 16. The L-shaped portions 26 are grouped in pairs and each pair have the L-shaped portions 26 facing each other, one being a mirror image of the other, to form C-shaped slots 28 with the base wall portion 16 that extend across the entire width of the slatwall panel 4.

The slatwall panel 4 includes a bottom edge portion 30 and a top edge portion 32. The bottom edge portion 30 includes an edge member portion 34, extending downwardly and offset rearwardly from the base wall portion 16. The top edge portion 32 includes an edge member portion 36 extending upwardly and offset rearwardly from the base wall portion 16. The edge member portion 36 is opposed from a top portion of the base wall portion 16 to form a connection groove 38 for receiving the edge member portion 34 from an adjacent slatwall panel 4. The edge member portions 34 and 36 preferably extend through the entire width of the slatwall panel 4.

Figure 3:
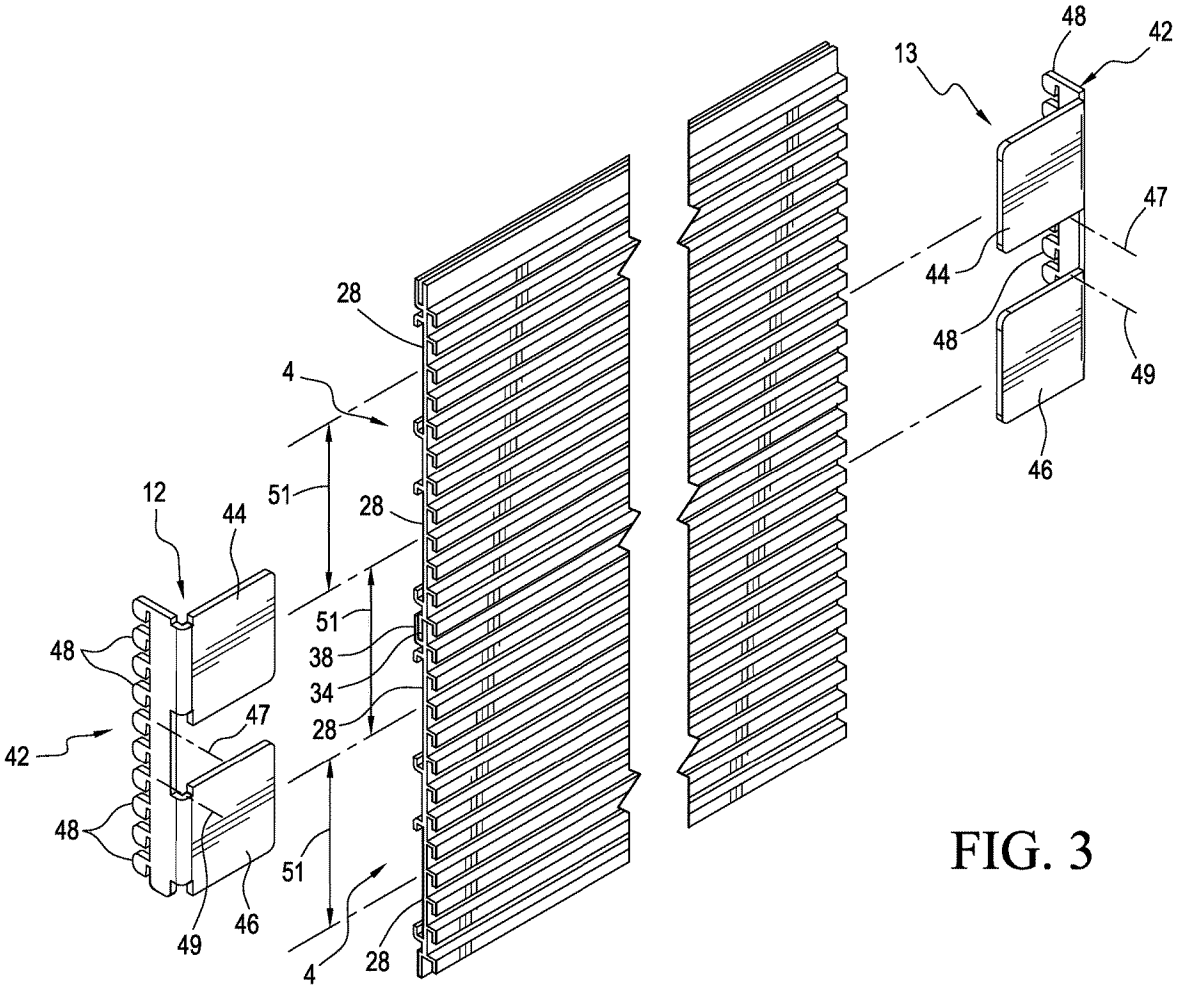
FIG. 3 is an assembly view of a slatwall of the present invention.

Referring to FIG. 3, two slatwall panels 4 are joined together to form a larger slatwall panel. The connection groove 38 of the bottom slatwall 4 receives the edge member portion 34 of the top slatwall panel 4 to form a seamless connection. A left-hand L-shaped bracket 12 and a right-hand L-shaped bracket 13 lock the two slatwall panels 4 together, advantageously preventing the separation of the two slatwall panels from each other.

The brackets 12 and 13 are mirror images of each other. Each of the brackets 12 and 13 includes a hanger portion 42 and an upper base portion 44 and a lower base portion 46. The base portions 44 and 46 are preferably flat and co-planar to one another and disposed preferably perpendicularly to the hanger portion 42. The hanger portion 42 is preferably flat with a series of hook portions 48.

The base portion 44 is receivable within the slot 28 near the bottom edge portion 32 of the top slatwall panel 4. The base portion 46 is receivable within the slot 28 near the top edge portion 30 of the bottom slatwall panel 4. The brackets 12 and 13 are slidable along the entire width of the slatwall walls 4.

The brackets 12 and 13 act as connectors with the base portion 44 secured in the lower slot 28 in the upper slatwall 4 and the base portion 46 similarly secured in the upper slot 28 of the adjacent lower slatwall panel 4. The brackets 12 and 13 when so installed lock the two slatwall panels 4 together, advantageously providing a stable assembly of the slatwall panels 4.

While two brackets 12 and 13 are shown, additional brackets may be used to allow additional support to wider slatwall panels 4.

At the upper slot 28 of the top slatwall panel 4, the bracket 12 and 13 may be cut along line 47 and use the remaining portion above the cut line 47, or along line 49 and use the remaining portion below the cut line 49. In this way, the brackets 12 and 13 will not stick out above or below the final slatwall panel 4.

The centerline distances 51 between adjacent slots 28 on the individual slatwall panel 4 or the assembly of several joined slatwall panels 4 are equal. Accordingly, the base portions 44 and 46 of the respective brackets 12 and 13 can fit into any two adjacent slots 28 regardless of whether the slots 28 are on a single slatwall panel 4 or on two adjacent slatwall panels 4. When only one slatwall panel 4 is required for the slatwall 2, the base portions 44 and 46 are inserted into the upper and lower slots 28 of the panel 4. Advantageously, the same bracket 12 may be used on a single slatwall panel 4 or an assembly of several slatwall panels 4.

Figure 4:
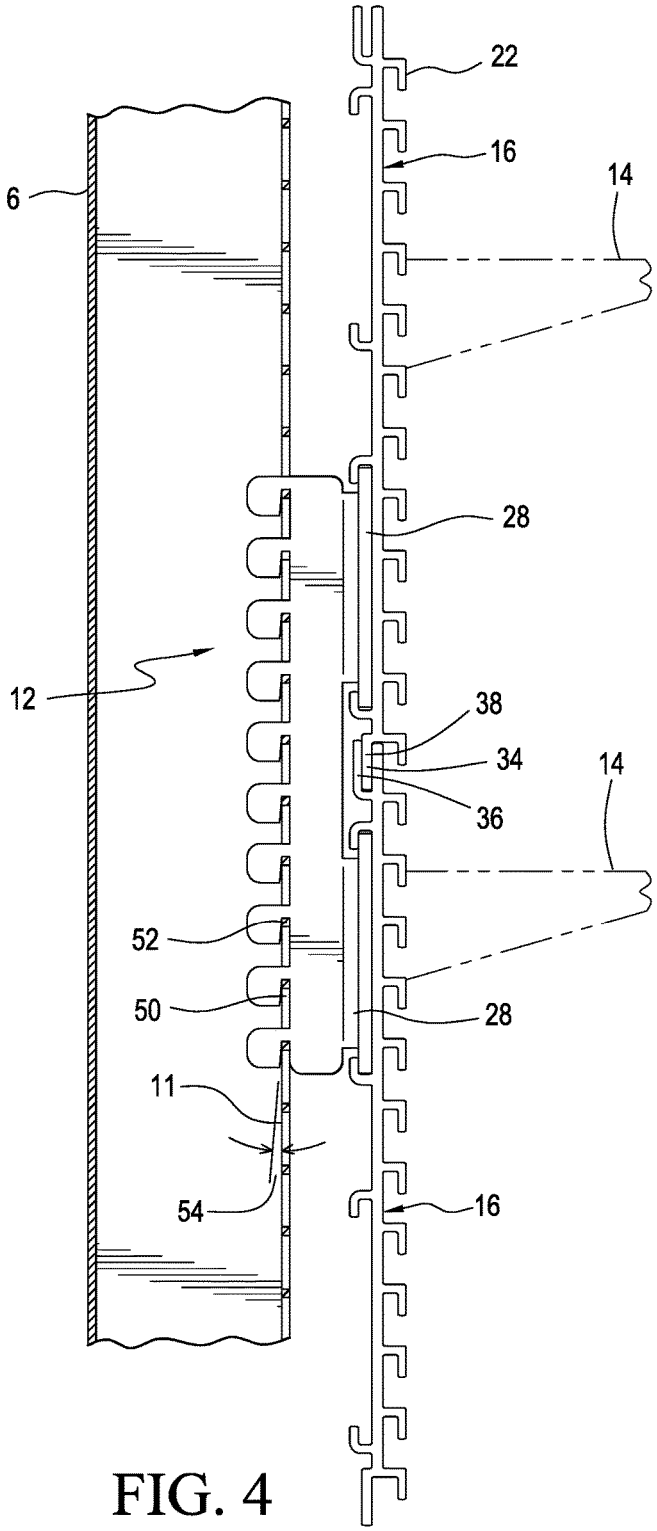
FIG. 4 is a cross-sectional view taken along line 4-4 in FIG. 1. The other slatwall panels and brackets are not shown for the sake of clarity.

Referring to FIG. 4, the upper slatwall panel 4 lines up with the lower slatwall panel 4 when joined together, thereby providing a seamless assembly. The base wall portion 16 of the upper slatwall panel lines up with the base wall portion of the lower slatwall panel so that the L-shaped portions also line up. This makes the assembly appear as one whole unit. The bracket 12 advantageously locks the two adjacent slatwall panels 4 together.

The hanger portion 42 is designed to be used with the slotted posts 6. The hook portions 48 are insertable into corresponding openings 11 in the respective posts 6. The slots 50 in the hook portions 48 receive the post portions 52 between the adjacent openings 11. The slots 50 are advantageously angled outwardly with an angle 54, preferably 5° to facilitate insertion of the respective post portions 52.

Figure 5:
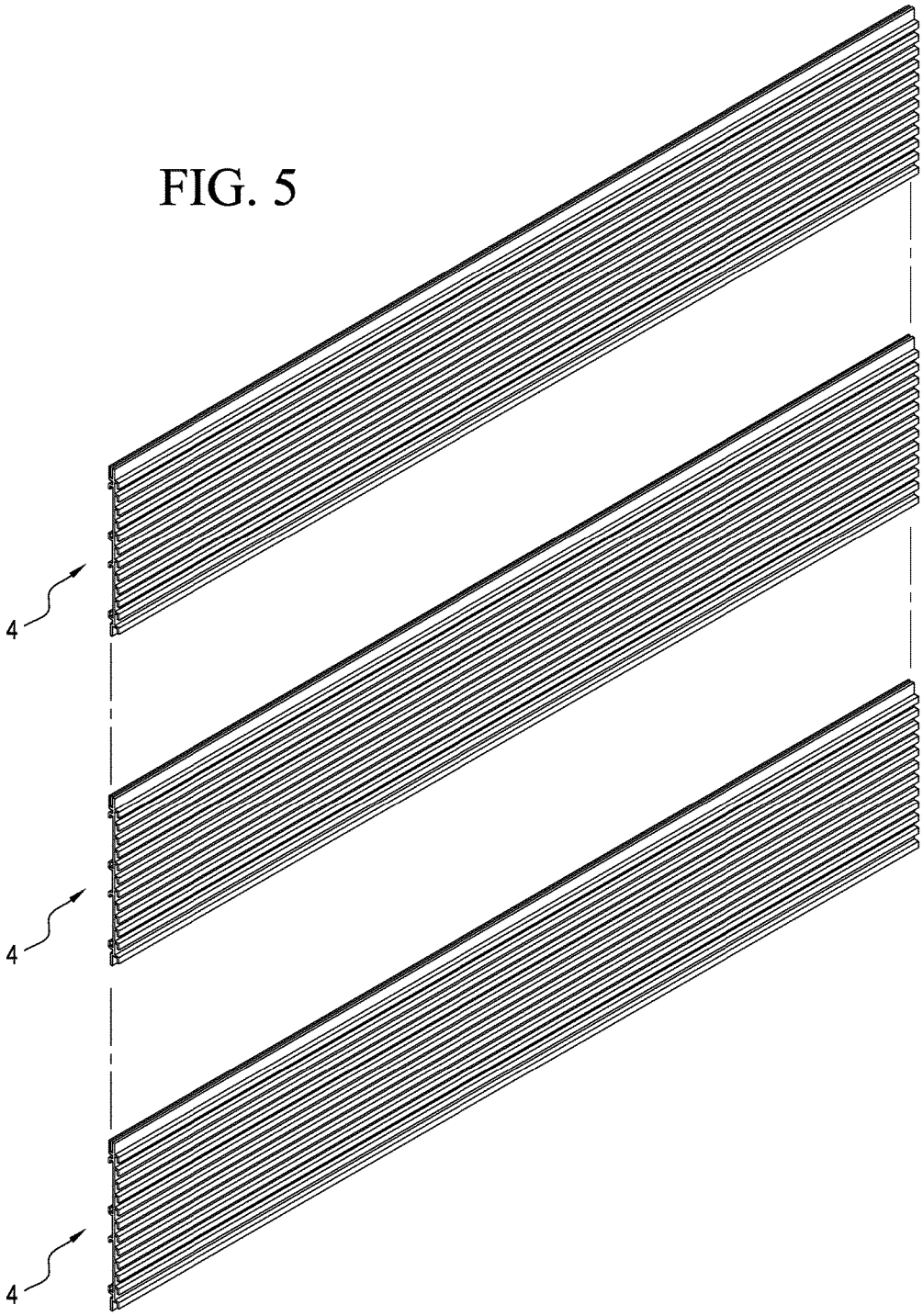
FIG. 5 is an assembly view of multiple slatwall panels of FIG. 2.

Referring to FIG. 5, several slatwall panels 4 may be joined together to form a much larger slatwall.

Figure 6:
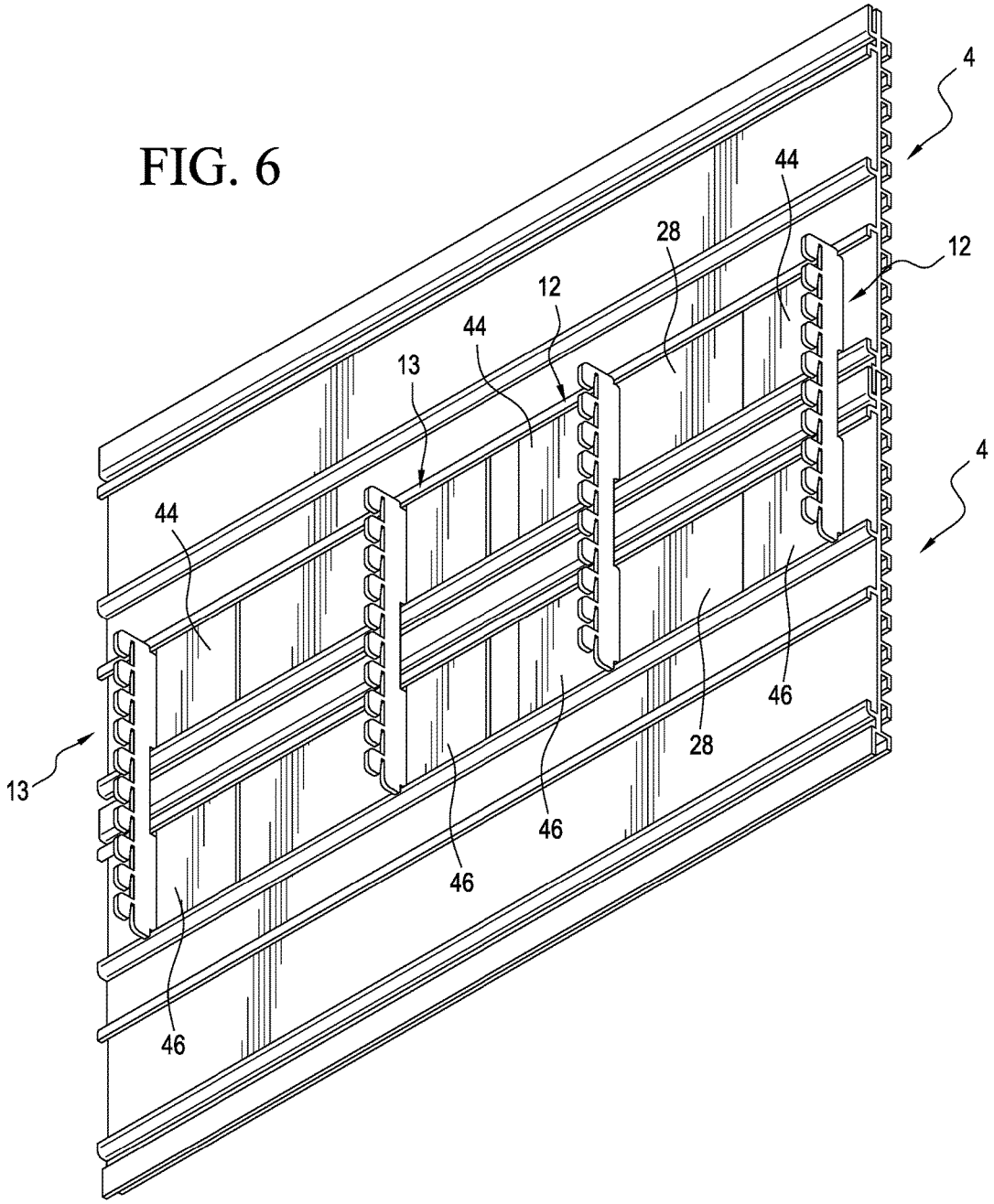
FIG. 6 is rear perspective view of an assembly of two slatwall panels of FIG. 2.

Referring to FIG. 6, multiple brackets 12 and 13 may be used, depending on the width of the slatwall 2. Since the brackets are slidable to any position along the slots 28, the brackets can be positioned to where the posts 6 are located.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A slatwall for displaying merchandise, comprising:

a) first and second slatwall panels each having a front side and a rear side, the slatwall panels each including a left edge portion and an opposite right edge portion, each of the slatwall panels including a top edge portion and a bottom edge portion, the bottom edge portion of the first slatwall panel is joined to the top edge portion of the second slatwall panel, each of the slatwall panels is a single piece;

b) the front side of each slatwall panel including a plurality of parallel grooves for securing thereto a plurality of support brackets;

c) the rear side of each slatwall panel including first and second C-shaped slots extending from the left edge portion to the opposite right edge portion, the first C-shaped slot is disposed parallel to and above the second C-shaped slot, each of the C-shaped slots is formed with first and second L-shaped projections extending from the rear side, the first L-shaped projection being a mirror image of the second L-shaped projection;

d) first and second L-shaped brackets each including first and second base portions transverse to a hanger portion, the first base portions are slidable along and retained in the second C-shaped slot of the first slatwall panel and the second base portions are slidable and retained in the first C-shaped slot of the second slatwall panel, each hanger portion is attachable to a respective post, the first L-shaped bracket is a mirror image of the second L-shaped bracket;

e) each of the slatwall panels includes a base wall portion with a front surface and a rear surface;

f) L-shaped portions attached to the front surface; and g) the L-shaped portions are spaced apart from each other to form the parallel grooves.

2. The slatwall as in claim 1, wherein the first slatwall panel is identical to the second slatwall panel.

3. The slatwall as in claim 1, wherein:

a) the top edge portion includes an upwardly extending portion offset rearwardly from the base wall portion to form a connection groove;

b) the bottom edge portion of each slatwall includes a downwardly extending portion offset rearwardly from the base wall portion; and c) the downwardly extending portion of the first slatwall panel is receivable within the connection groove of the second slatwall panel.

4. The slatwall as in claim 1, wherein the base wall portion of each slatwall panel is planar.

5. The slatwall as in claim 1, wherein:

a) the first and second base portions and the hanger portion of each of the first and second L-shaped brackets are planar; and b) the first and second base portions are perpendicular to the hanger portion.

6. The slatwall as in claim 1, wherein each of the L-shaped brackets is positionable along the respective first and second C-shaped slots.

7. The slatwall as in claim 1, wherein the hanger portion of each L-shaped bracket includes a plurality of hook portions with respective slots.

8. A slatwall system for displaying merchandise, comprising:

a) a slatwall panel including a front side and a rear side, the slatwall panel including a left edge portion and an opposite right edge portion, a top edge portion and a bottom edge portion, the slatwall panel is a single piece;

b) the front side including a plurality of parallel grooves for securing thereto a plurality of support brackets;

c) the rear side including a C-shaped slot extending from the left edge portion to the opposite right edge portion, the C-shaped slot is formed with first and second L-shaped projections extending from the rear side, the first L-shaped projection being a mirror image of the second L-shaped projection;

d) first and second L-shaped brackets each including a base portion transverse to a hanger portion, the hanger portion is attachable to a respective post, the first L-shaped bracket is a mirror image of the second L-shaped bracket, the base portion of each L-shaped bracket is slidable along and retained in the C-shaped slot;

e) each of the slatwall panels includes a base wall portion with a front surface and a rear surface;

f) L-shaped portions attached to the front surface; and g) the L-shaped portions are spaced apart from each other to form the parallel grooves.

9. The slatwall as in claim 8, wherein:

a) the top edge portion includes an upwardly extending portion offset rearwardly from the base wall portion to form a connection groove;

b) the bottom edge portion includes a downwardly extending portion offset rearwardly from the base wall portion; and c) the downwardly extending portion is receivable within a connection groove of an adjacent slatwall panel.

10. The slatwall as in claim 8, wherein the base portion is planar.

11. The slatwall as in claim 8, wherein the base portion is perpendicular to the hanger portion.

12. The slatwall as in claim 8, wherein each of the L-shaped brackets is positionable along the C-shaped slot.

13. The slatwall as in claim 8, wherein the hanger portion of each L-shaped bracket includes a plurality of hook portions with respective slots.

14. The slatwall as in claim 1, wherein each of the first and second C-slots is disposed across more than one of the plurality of parallel grooves on the front side of the slatwall panel.

* * * * *